US006142464A

United States Patent [19]

Bodereau et al.

[11] Patent Number: 6,142,464

[45] Date of Patent: Nov. 7, 2000

[54] STACKING PRESSURE CONTROL DEVICE FOR A HORIZONTAL BOOK STACKING DEVICE

[75] Inventors: Jean-Pierre Bodereau; Gilles Bodereau; Laurent Vernon, all of La Ferte Bernard, France

[73] Assignee: Realisations, Etudes & Commercialsation de Materiel pour l'Industrie, Societe Anonyme, La Ferte Bernard, France

[21] Appl. No.: 09/043,093

[22] PCT Filed: Nov. 13, 1996

[86] PCT No.: PCT/FR96/01791

§ 371 Date: Jul. 13, 1998

§ 102(e) Date: Jul. 13, 1998

[87] PCT Pub. No.: WO97/18152

PCT Pub. Date: May 22, 1997

[30] Foreign Application Priority Data

Nov. 13, 1995 [FR] France ..... 95/13408

[51] Int. Cl.[7] ..... B65H 29/00; B65H 31/06

[52] U.S. Cl. ..... 271/176; 271/177; 271/213

[58] Field of Search ..... 271/176 O, 177 C, 271/213 C, 214

[56] References Cited

U.S. PATENT DOCUMENTS

| | | | |
|---|---|---|---|
| 5,064,185 | 11/1991 | Ricciardi | 271/181 X |
| 5,104,109 | 4/1992 | Kubo | 271/3.1 X |
| 5,224,697 | 7/1993 | Darchis et al. | 271/201 X |

*Primary Examiner*—Christopher P. Ellis
*Assistant Examiner*—Kenneth W. Bower
*Attorney, Agent, or Firm*—Young & Thompson

[57] ABSTRACT

A stacking pressure control device for a stationary horizontal book stacking device in which books (C) fed at a constant rate along a vertical wall (2) are stacked on a stacking table (1). The control device consists of a strain gauge used as a pressure sensor (3, 6, 8) for continuously measuring the stacking pressure exerted directly on the vertical wall (2), and controlling the speed of the stacking table (1). The control device may be used in a horizontal book stacking device.

6 Claims, 3 Drawing Sheets

STACKING PRESSURE CONTROL DEVICE FOR A HORIZONTAL BOOK STACKING DEVICE

CROSS REFERENCE TO RELATED APPLICATION

This is the 35 USC 371 National Stage of International application PCT/FR96/01791 filed on Nov. 13, 1996, which designates the United States of America.

FIELD OF THE INVENTION

The present invention relates to a device for regulating the stacking pressure in a horizontal signature stacking device. Such a horizontal signature stacking device is disclosed in French patent application 94 04031 of the applicant.

BACKGROUND OF THE INVENTION

It has been noted that obtaining a high quality stack depends in large part on the constancy of the stacking pressure. However, this constant stacking pressure for a given signature of a given production changes from one production to another because of the change in conditions of production, given the variations of the parameters of production which are the thickness of the paper, the thickness of the ink, the variation of weight, of the interval of the lap, etc.

It has also been noted that the production conditions can also change within a same production. As a result, it is necessary to be able to adapt the stacking pressure between two different productions but also within a same production so as to achieve a stack of good quality. It is thus necessary to be able to measure continuously this stacking pressure so as to adjust it.

Most of the stacking devices do not comprise a device for the regulation of the stacking pressure and the latter is thus affixed indirectly by the value of the speed of advance of the stacking table. In this type of "stolen" device, it is not possible to intervene so as to permit adjustment of the stacking pressure in the course of production. Only a variation of the speed of the stacking table permits adjusting, as needed, the stacking pressure between different productions.

A solution seeking to permit adjustment of the stacking pressure consists in using in the stacking device a floating stacking head as in EP-A-0 623 542, which is to say that there can be obtained a variable stacking point permitting variation of the stacking pressure. However, in this case, the detection device operating by gravity on the floating stacking device must overcome its own inertia. Moreover, the stacking can be disturbed because the stacking pressure must be sufficiently great to overcome the inertia of the floating device, which risks spoiling the signatures by marking on the fold (unrolling phenomenon) or on the printed matter (staining phenomenon).

The stacking pressure depends on the parameters of arriving and leaving of the signatures during stacking. Thus, the larger the arrival flow rate of the signatures for a constant departure rate of the signatures, the greater the stacking pressure, and vice versa. On the other hand, for a constant flow rate of arrival of signatures, the greater the exit flow rate of signatures the less the stacking pressure, and vice versa.

It is therefore important that the measurement of the stacking pressure in the course of a production permits modifying certain parameters of stacking, in particularly the output flow rate of the signatures, so as to obtain a constant stacking pressure whilst preserving stacking conditions which must not be upset by this measurement. Thus, it is important to maintain a stacking point as stationary as possible.

One solution thus consists in providing a device for regulating the stacking pressure in which this pressure is measured. Thus, there can be positioned a plate in the vertical arrival path of the signatures on the stacking table, as in EP-A-0 339 002. This plate is pivotally mounted at its upper end and is connected to a lever connected at its lower end to a spring. Upon arrival of the signatures on the table, the plate pivots as a function of the pressure of said signatures and the lever also moves. A sensor detects the movement of said signature and controls the adjustment of the speed of advance of the table as a function of the information received.

However, in such a device, the plate interferes with the arrival of the signatures or rubs against said signatures, which upsets the stacking which thus is not sufficiently precise.

In JP-A-59102761, it is proposed to position a pressure detector in the vertical arrival path of the signatures, which drives the advance of the stacking table by a certain value when it detects a value of pressure above a predetermined level. Such a device does not permit continuous regulation of the stacking pressure and is moreover adapted to adjust, stepwise, the advance of the signatures on the stacking table. Because of this, there is obtained a stacking whose precision is only so-so and is disturbed.

U.S. Pat. No. 4,772,003 discloses a device in which a vertical supply belt for the signatures is swingably mounted so as to constitute a pressure sensor, the swinging being measured to adjust as a result the speed of advance of the stack. However, such a device must first overcome its own inertia before being able to give an accurate measurement of the stacking pressure. Because of this, the measurement is often imprecise or of threshold effect.

SUMMARY OF THE INVENTION

So as to overcome these drawbacks, the present invention proposes a device for adjustment of the stacking pressure, permitting continuous measurement of this pressure so as to act on the output flow rate of the signatures from the stacking point by modifying the speed of advance of the stacking table whilst maintaining the stacking point as stationary as possible by maintaining the stacking pressure constant.

To this end, the invention has for its object a device for adjustment of the stacking pressure for a fixed horizontal signature stacking device on a stacking table with arrival along a vertical stacking wall of signatures, characterized in that it is constituted by a strain gauge acting as a pressure sensor adapted continuously to measure the stacking pressure exerted directly on the vertical wall and to exert a control on the speed of the stacking table.

Thus, preferably, the strain gauge acting as a stacking pressure detector can be disposed so as to measure directly, continuously and linearly, the pressure exerted on the vertical wall so as to detect the variations taking place in the course of a production so as to act on the speed of the stacking table, thereby permitting correcting variations of the pressure and maintaining it constant throughout stacking.

Moreover, preferably, the device comprises a potentiometer permitting fixing electrically a desired stacking pressure at the stacking point, by acting not only physically on the pressure but also on the electrical signal from the strain gauge, which permits avoiding any mechanical adjustment of the pressure beyond a tare upon installation of the device.

There is obtained in this manner an adjustment of the pressure over all the range of the strain gauge as well as the possibility of causing to vary the value of the stacking pressure sought as a function of the wishes of the users.

Thus, one can, as a function of the value of the stacking pressure fixed by means of the potentiometer, obtain a variation of the pressure between signatures during stacking.

According to a first embodiment of the invention, the strain gauge is disposed behind the vertical wall and hence measures directly the pressure exerted by the stack of signatures on said wall, transforming it into an electrical signal controlling the control means of the speed of the stacking table.

When the vertical wall is constituted by stacking belts, the axis of rotation of the pulleys over which pass at least the central stacking belts, adjacent the point of stacking on the stacking table, is connected by a rod pivotally mounted about a second axis parallel to said axis of rotation.

According to a second embodiment of the invention, the strain gauge is thus placed so as to extend against this rod.

Under the influence of the pressure exerted by the signatures during stacking, said pulley axis is free to pivot about the second axis by means of the rod. The strain gauge extending against said rod is therefore positioned to measure directly the pressure exerted by the signatures on the stacking belts and transforms this measurement into an electrical signal acting on the speed of the stacking table.

The device according to the invention preferably permits measuring the pressure at a single point, thereby avoiding disturbances and this, even for a minimum displacement of the stacking point and over all the range of the strain gauge, thereby permitting obtaining an analog and linear measure adapted to accelerate or retard the advance of the stacking table without giving rise to disturbances.

Preferably, the device is sufficiently miniaturized so as not to upset stacking during measurement of the pressure of said stack, thereby not giving rise to a displacement d of the stacking point of more than 3 mm and in particular, the strain gauge permits preferably carrying out these measurements for displacements d from the point of stacking, less than 1 mm.

Thus, the force exerted by the pressure of the signatures is sufficiently detectable by a strain gauge to permit a measurement of the variation of the pressure, but also sufficiently low to permit avoiding any disturbance within the stack. Moreover, any variation of pressure on said stacking point is immediately compensated by the device according to the invention because of the continuous measurement of this pressure.

BRIEF DESCRIPTION OF THE DRAWINGS

There will now be described in greater detail the present invention with reference to the accompanying drawing, in which.

DESCRIPTION OF THE PREFERRED EMBODIMENTS

The horizontal signature stacking device comprises, schematically, a stacking table 1 and a vertical stacking wall 2. The signatures C arrive along the vertical wall 2, their spine first, and then abut against the stacking table 1. A fixed stacking head (not shown) triggers stacking. The arriving flow rate of the signatures C is preferably constant whilst the outlet flow rate of the signatures C, depending on the speed of the stacking table 1, can be modified by the regulating device of the pressure according to the invention.

Figure 1:
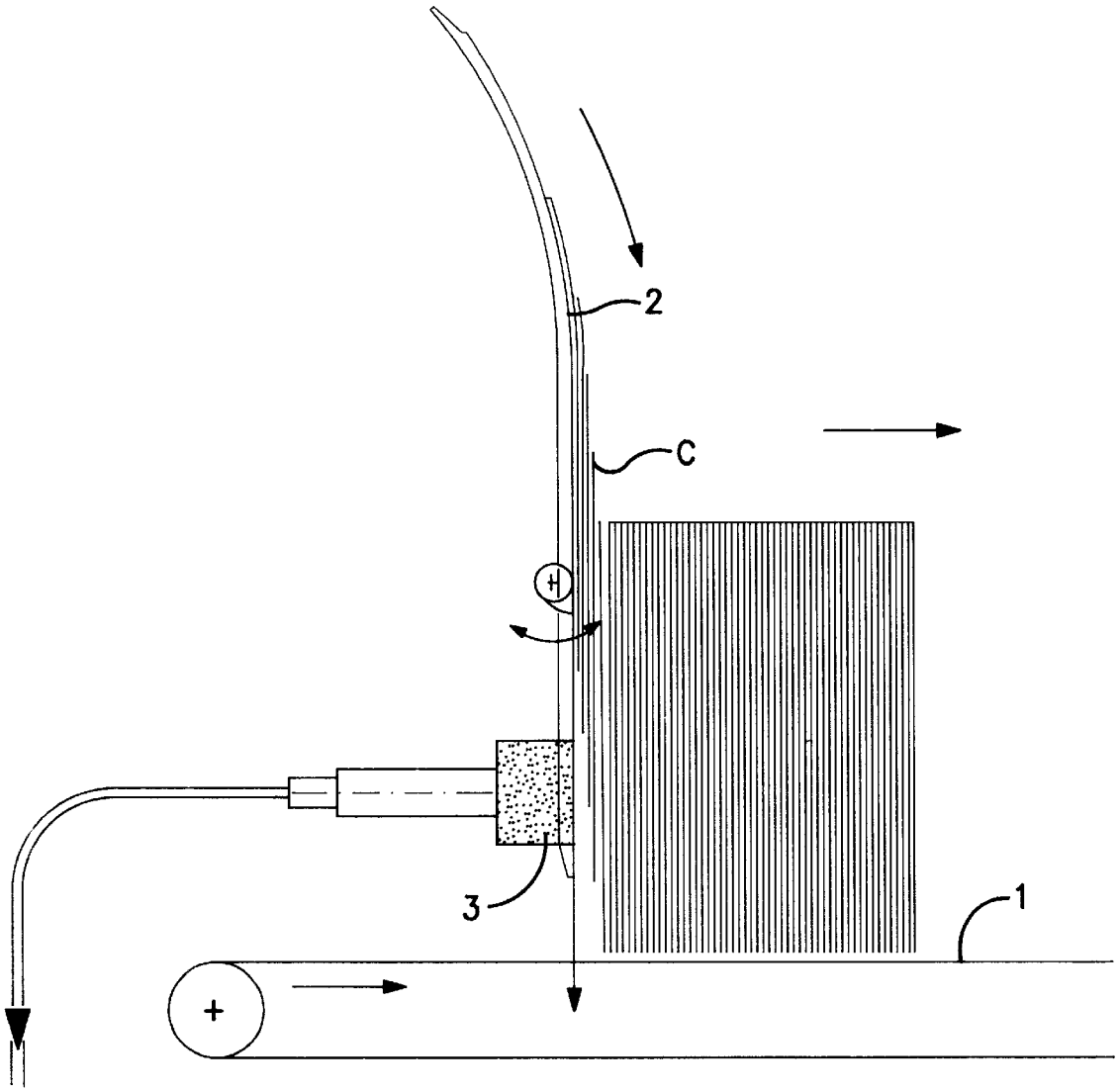
FIG. 1 shows a side elevational view of the first embodiment of the regulation device of the invention.

In FIG. 1, a strain gauge 3, disposed behind the vertical wall 2, measures directly the pressure exerted by the stack of signatures C on said vertical wall 2 and transforms it into an electrical signal controlling the control means of the speed of the stacking table 1.

Figure 2:
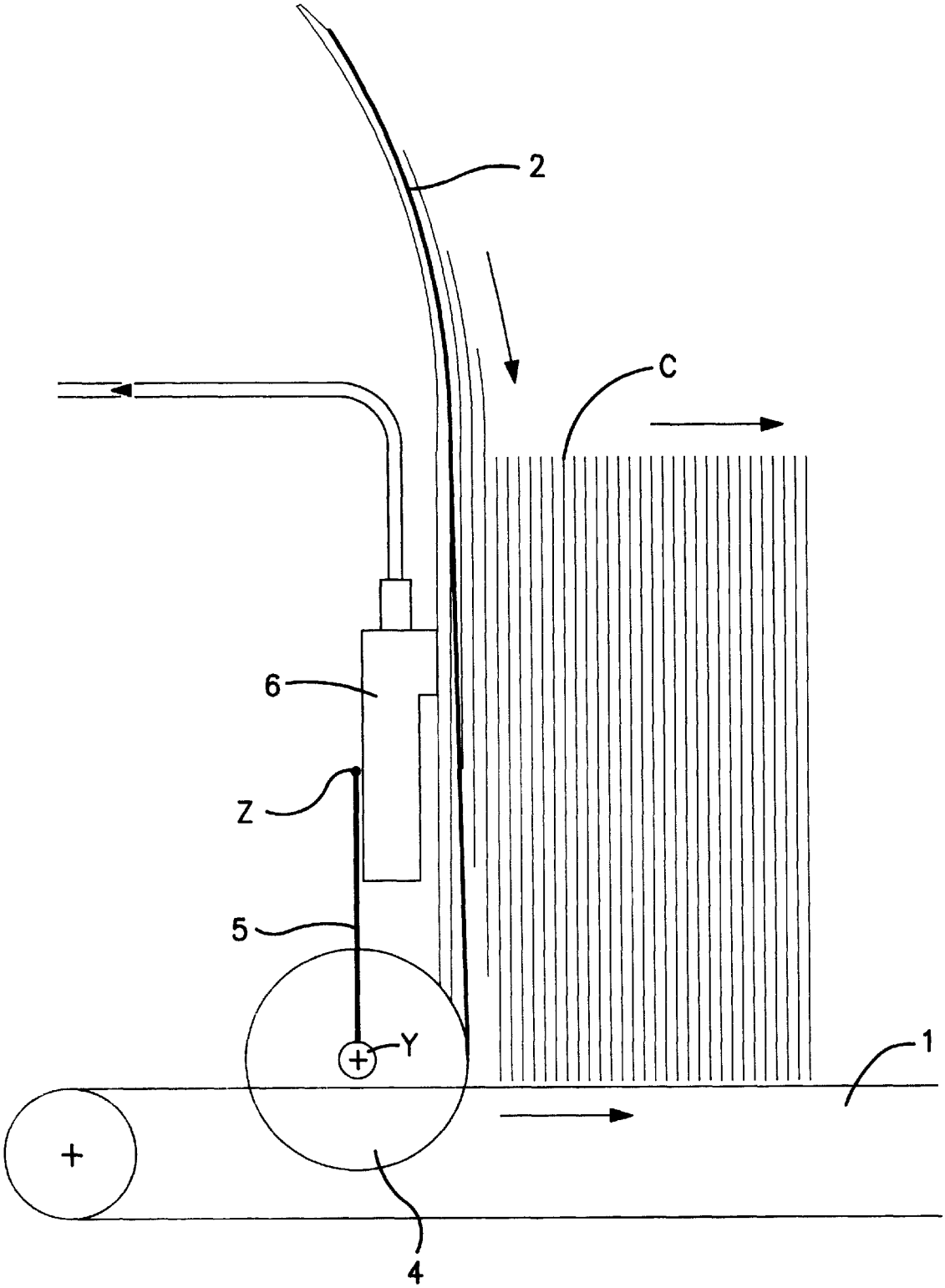
FIG. 2 shows a side elevational view of the second embodiment of the regulation device of the invention.

In FIG. 2, there is shown a second embodiment of the invention in which the vertical wall 2 is constituted by belts. The axis Y of rotation of the pulleys 4 about which the belts are trained, is connected by a rod 5 to a parallel Z axis. The rod 5 is mounted pivotally about said Z axis and is fixed on the Y axis. A strain gauge 6 extends along the rod 5, between said rod 5 and the vertical wall 2, and directly measures the pressure exerted by the signatures on said vertical wall 2 because of the constraint exerted by the rod 5 on said gauge 6 during pivoting of said rod 5.

Thus, because of the stacking pressure against the vertical wall 2, or more precisely against the pulleys, said axis Y of the pulleys is free to pivot about a second axis Z by means of the rod 5 and hence to move itself. The strain gauge 6 measures the strain exerted, varying as a function of the distance d of displacement of the stacking point, and transforms it into an electrical quantity which acts on the control means of the speed of the stacking table 1.

Figure 3:
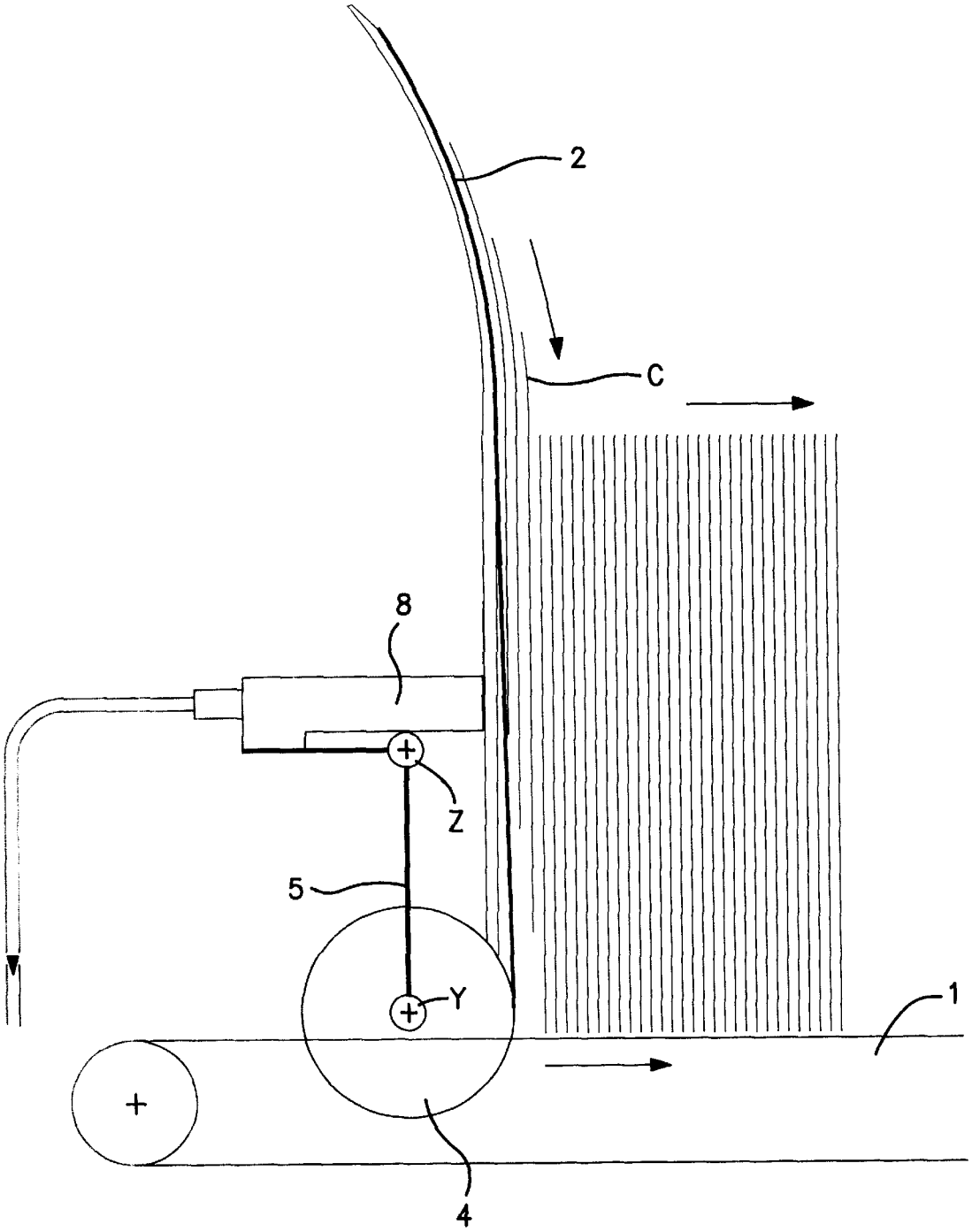
FIG. 3 shows a side elevational view of a modification of FIG. 2.

According to the modification of FIG. 3, the rod 5 forms a right angle at the axis Z and has a portion 7 extending perpendicularly. This portion 7 of the rod 5 extends against a strain gauge 8 which measures the variations of the strain exerted by the portion 7 of the rod 5 according to the movement of said rod 5 directly under the influence of the pressure exerted by the signatures C on the vertical wall 2.

What is claimed is:

1. Device for regulating the stacking pressure in a horizontal signature stacking device with arrival of signatures along a substantially stationary vertical wall, the signatures subsequently resting on a stacking table, the device comprising:

a strain gauge acting as a pressure sensor adapted to continuously measure the stacking pressure exerted directly on the vertical wall and to transform the pressure into an electrical signal to a control means, thereby controlling the speed of the stacking table.

2. The device according to claim 1, wherein the strain gauge is disposed behind the vertical wall and directly measures the pressure exerted by the stack of signatures on said wall.

3. The device according to claim 1, wherein the vertical wall is constituted by stacking belts trained about pulleys having an axis of rotation Y connected by a rod mounted pivotally about a second axis Z parallel to said axis of rotation Y, and the strain gauge is thus disposed in a manner to extend against said rod.

4. The device according to claim 3, wherein the strain gauge extends along the rod, between the rod and the vertical wall.

5. The device according to claim 4, wherein the rod forms a right angle at the level of the second axis Z and has a portion extending perpendicularly, the strain gauge extending along the length of said portion.

6. The device according to claim 1, further comprising a potentiometer to electrically fix the desired pressure at the stacking point.

* * * * *